US010921735B2

(12) United States Patent
Soeda

(10) Patent No.: US 10,921,735 B2
(45) Date of Patent: Feb. 16, 2021

(54) FIXING DEVICE AND IMAGE FORMING APPARATUS HAVING A PLURALITY OF HEATERS

(71) Applicant: Oki Data Corporation, Tokyo (JP)

(72) Inventor: Teruo Soeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/791,686

(22) Filed: Feb. 14, 2020

(65) Prior Publication Data

US 2020/0301325 A1 Sep. 24, 2020

(30) Foreign Application Priority Data

Mar. 20, 2019 (JP) ..... 2019-052256

(51) Int. Cl.
*G03G 15/20* (2006.01)
*B65H 5/02* (2006.01)

(52) U.S. Cl.
CPC ..... *G03G 15/2028* (2013.01); *G03G 15/2053* (2013.01); *B65H 5/023* (2013.01); *G03G 2215/00139* (2013.01); *G03G 2215/2016* (2013.01); *G03G 2215/2035* (2013.01)

(58) Field of Classification Search
CPC . G03G 15/2039–2046; G03G 15/2053; G03G 2215/2035
See application file for complete search history.

(56) References Cited

U.S. PATENT DOCUMENTS 5,376,773 A * 12/1994 Masuda ..... G03G 15/2003 219/216

FOREIGN PATENT DOCUMENTS

JP 2017-173583 A 9/2017

* cited by examiner

*Primary Examiner* — Arlene Heredia
(74) *Attorney, Agent, or Firm* — Rabin & Berdo, P.C.

(57) ABSTRACT

A fixing device includes a belt unit and an opposite member. The belt unit and opposite member are configured to, when a recording medium with a developer image transferred thereon passes through a nip region formed by the belt unit and opposite member, fix the developer image to the recording medium. The belt unit includes an endless belt, a heater group including a plurality of stacked heaters, and a holder that holds the heater group inside the belt.

10 Claims, 8 Drawing Sheets

FIXING DEVICE AND IMAGE FORMING APPARATUS HAVING A PLURALITY OF HEATERS

BACKGROUND OF THE INVENTION

1. Field of the Invention

The present invention relates to a fixing device and an image forming apparatus using the fixing device, and more particularly, to a configuration of a heater used in a fixing device.

2. Description of the Related Art

There is known an image forming apparatus that uses a heater including resistance heating elements for multiple heating patterns and adjusts the amounts of heat generation of the heater at a central portion and end portions to prevent partial overheating (see, e.g., Japanese Patent Application Publication No. 2017-173583).

However, a heater including resistance heating elements for multiple heating patterns formed on the same plane requires a complicated wiring pattern for the resistance heating elements, and thus requires a large heater width. This enlarges peripheral members accompanying the heater and increases the thermal capacity of the peripheral members. This is disadvantageous to quick start.

SUMMARY OF THE INVENTION

An object of an aspect of the present invention is to provide a fixing device having a small heater width.

According to an aspect of the present invention, there is provided a fixing device comprising: a belt unit; and an opposite member, the belt unit and the opposite member being configured to, when a recording medium with a developer image transferred thereon passes through a nip region formed by the belt unit and the opposite member, fix the developer image to the recording medium. The belt unit includes: an endless belt; a heater group comprising a plurality of stacked heaters; and a holder that holds the heater group inside the belt.

DETAILED DESCRIPTION OF THE INVENTION

Figure 1:
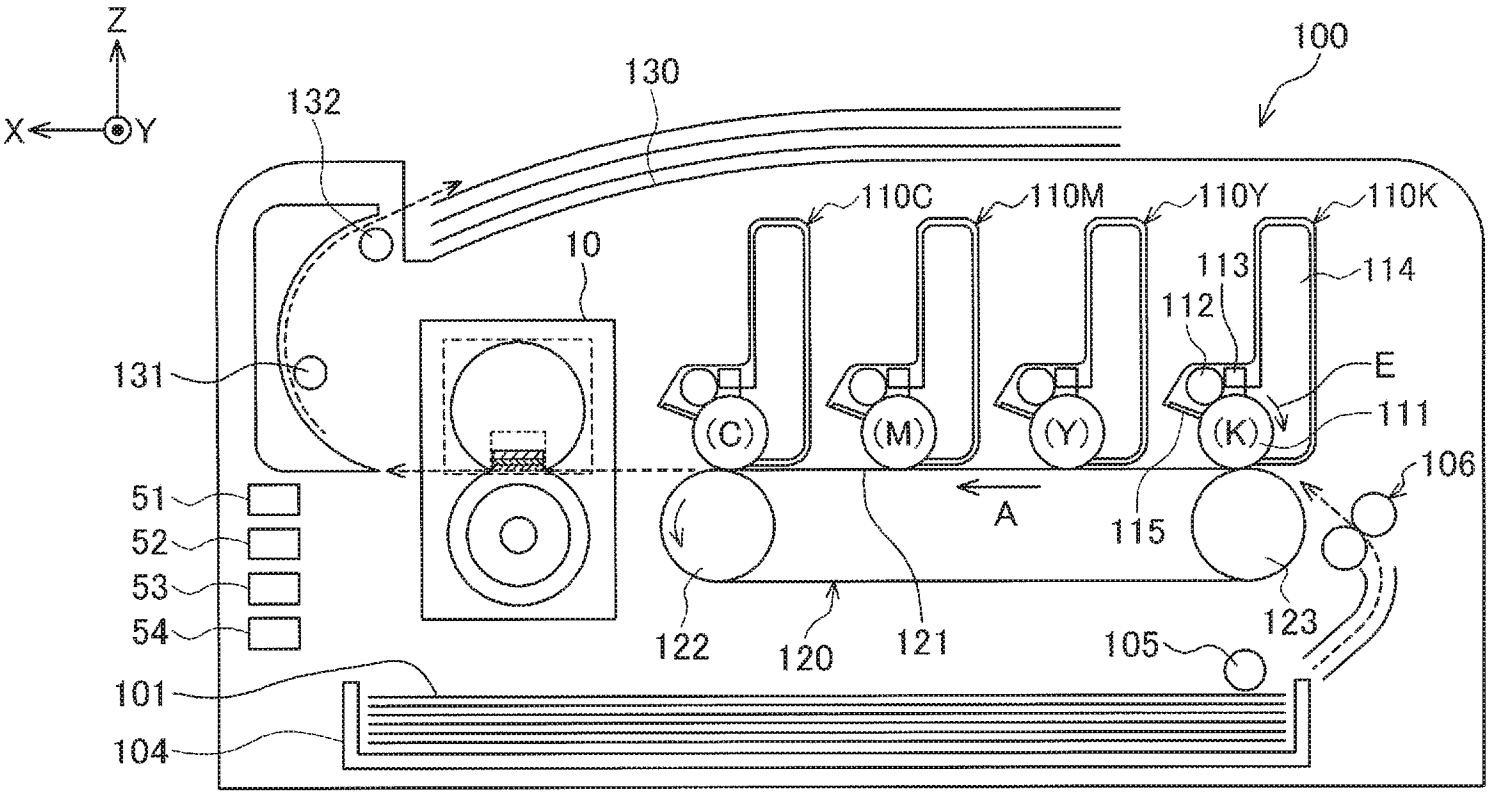
FIG. 1 is a view schematically illustrating main components of an image forming apparatus that employs a fixing device of an embodiment of the present invention.

FIG. 1 is a view schematically illustrating main components of an image forming apparatus 100 that employs a fixing device 10 of an embodiment of the present invention.

The image forming apparatus 100 illustrated in FIG. 1 is, for example, a color electrophotographic printer. The image forming apparatus 100 includes a sheet feed cassette 104 that stores recording sheets 101 as recording media, a sheet feed roller 105 that picks up a recording sheet 101 from the sheet feed cassette 104, and a pair of registration rollers 106 that feed the recording sheet 101 to an image forming portion at a predetermined time. The image forming apparatus 100 also includes a developing device 110K that forms a black (K) toner image, a developing device 110Y that forms a yellow (Y) toner image, a developing device 110M that forms a magenta (M) toner image, and a developing device 110C that forms a cyan (C) toner image, which are arranged in this order from an upstream side along a conveying path of the recording sheet 101. The developing devices 110K, 110Y, 110M, and 110C constitute the image forming portion. The toner images are developer images. The developing devices 110K, 110Y, 110M, and 110C have the same configuration except that they use toners of different predetermined colors of black, yellow, magenta, and cyan, respectively. When the developing devices 110K, 110Y, 110M, and 110C need not be distinguished from each other, they may be referred to simply as the developing devices 110.

As illustrated in the developing device 110K of FIG. 1, each developing device 110 includes a photosensitive drum 111 as an electrostatic latent image carrier, and also includes a charging device 112 that charges a surface of the photosensitive drum 111, an exposure device 113 that selectively illuminates the charged surface of the photosensitive drum 111 with light based on image data to form an electrostatic latent image, a developer supply device 114 that develops the electrostatic latent image formed on the photosensitive drum 111 with the toner to form a toner image, a cleaning device 115 disposed in contact with the photosensitive drum 111 to remove toner remaining on the surface of the photosensitive drum 111, and the like, which are arranged around the photosensitive drum 111 in this order from an upstream side in a rotational direction (indicated by arrow E) of the photosensitive drum 111.

The image forming apparatus 100 also includes a belt-type transfer device 120, which includes an endless transfer belt 121 that conveys the recording sheet 101 and sequentially transfers the toner images formed by the respective developing devices 110 onto the conveyed recording sheet 101, a drive roller 122 that is rotated by a driver 51 to drive the endless transfer belt 121 in the direction of arrow A, and a tension roller 123 that is paired with the drive roller 122 and stretches the endless transfer belt 121 together with the drive roller 122.

The image forming apparatus 100 also includes the fixing device 10 that fixes the toner image formed on the recording sheet 101 to the recording sheet 101 by applying heat and pressure to the toner image, and conveying rollers 131 and 132 that convey the recording sheet 101 that has passed through the fixing device 10 and discharge it onto a discharged sheet stacker 130 for stacking recording sheets 101 with toner images fixed thereto. The fixing device 10 will be described later in detail.

In FIG. 1, the X axis extends in a conveying direction in which the recording sheet 101 passes through the image forming portion, the Y axis extends in a direction of rotational axes of the photosensitive drums 111, and the Z axis extends in a direction perpendicular to both the X and Y axes. The same applies to the X, Y, and Z axes shown in other drawings. In each of the other drawings, the X, Y, and Z axes indicate the orientation of the part illustrated in the drawing when the part is installed in the image forming apparatus 100 illustrated in FIG. 1. Here, the image forming apparatus 100 is placed so that the Z axis extends in a substantially vertical direction.

A printing operation of the image forming apparatus 100 having the above configuration will be generally described with reference to FIG. 1. The dashed arrows in FIG. 1 indicate the conveying direction in which the recording sheet 101 is conveyed.

When the image forming apparatus 100 is turned on and an operator performs an operation to start image formation, a recording sheet 101 stored in the sheet feed cassette 104 is picked up from the sheet feed cassette 104 by the sheet feed roller 105, subjected to skew correction by the pair of registration rollers 106, and then conveyed to the image forming portion, which is constituted by the four developing devices 110 and transfer device 120, at a predetermined time.

Meanwhile, in each developing device 110, as the photosensitive drum 111 rotates in the direction of arrow E, the charging device 112 is applied with a voltage by a power supply 52 and charges the surface of the photosensitive drum 111. Then, when the charged surface of the photosensitive drum 111 reaches the vicinity of the exposure device 113, the exposure device 113 exposes the charged surface to form an electrostatic latent image according to image information on the surface of the photosensitive drum 111. The developer supply device 114 develops the electrostatic latent image to form a toner image of the corresponding color on the surface of the photosensitive drum 111.

The recording sheet 101 conveyed to the image forming portion is attracted by the endless transfer belt 121 and conveyed in the direction of arrow A. When the recording sheet 101 is sequentially nipped by the photosensitive drums 111 rotating in the direction of arrow E of the respective developing devices 110 and the endless transfer belt 121, the toner images of the respective colors of black (K), yellow (Y), magenta (M), and cyan (C), which are formed at predetermined times, are sequentially transferred onto the recording sheet 101 in a superimposed manner, so that a color image constituted by the toners is formed on the recording sheet 101. In each developing device 110, the cleaning device 115 scrapes off residual toner remaining on the photosensitive drum 111 after the transfer, thereby cleaning the photosensitive drum 111, which is then charged by the charging device 112.

The recording sheet 101 with the color image formed thereon is then conveyed to the fixing device 10. The fixing device 10 presses and heats the toner image on the recording sheet 101, thereby fusing and fixing it onto the recording sheet 101. The recording sheet 101 is then discharged by the conveying rollers 131 and 132 to the discharged sheet stacker 130, and the printing operation ends.

Figure 2:
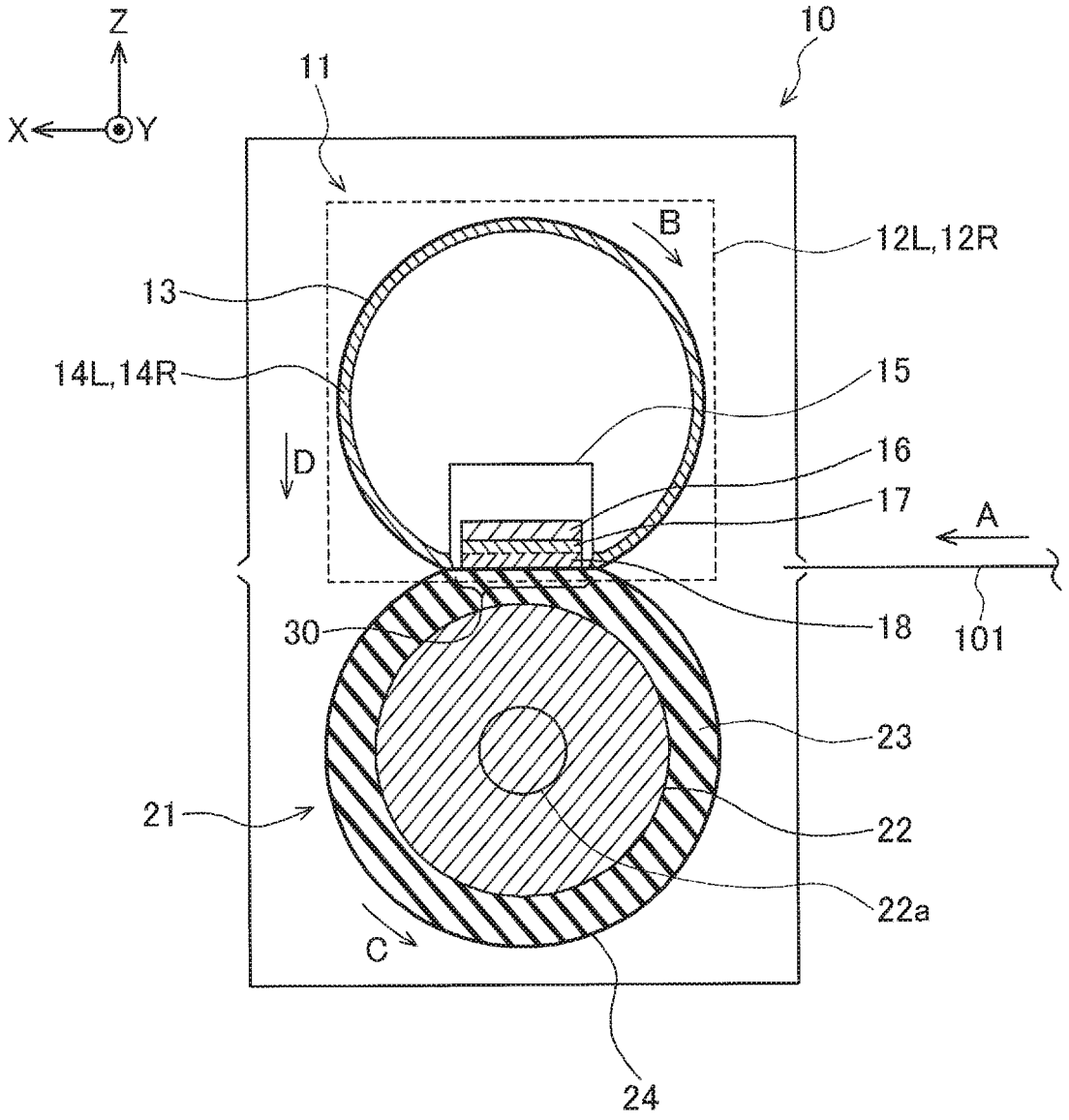
FIG. 2 is a view of main components of the fixing device of the embodiment.

FIG. 2 is a view of main components of the fixing device 10 of the embodiment. As illustrated in FIG. 2, the fixing device 10 of the embodiment includes a fixing belt unit 11 as a belt unit, and a drive roller 21 as an opposite member.

The drive roller 21 includes a roller-shaped metal core 22 made of iron, an elastic layer 23 disposed on an outer periphery of the metal core 22 and made of silicone rubber, and a tube layer 24 disposed on an outer periphery of the elastic layer 23 and made of tetrafluoroethylene-perfluoroalkyl vinyl ether copolymer (PFA). The metal core 22 includes a rotation shaft 22*a* disposed in its longitudinal direction (or the Y axis direction). Both end portions of the rotation shaft 22*a* are rotatably supported by bearings (not illustrated) mounted in a body (or chassis) of the fixing device 10.

The fixing belt unit 11 includes a fixing belt 13 as an endless belt, a heater group including multiple stacked heaters (here, a first heater 17 and a second heater 18), and a stay 15 as a holder that holds the heater group inside the fixing belt 13. The multiple stacked heaters have different heating patterns. The stay 15 extends in its longitudinal direction (or the Y axis direction). The fixing belt unit 11 also includes left and right side plates 12L and 12R fixed to left and right end portions of the stay 15. In this description, directional terms, such as left, right, up, down, front, or rear, with respect to the fixing device 10 may refer to directions when the fixing device 10 is viewed in the sheet conveying direction (or the direction of arrow A).

Left and right belt guides 14L and 14R, which are arc-shaped, are formed on the left and right side plates 12L and 12R, respectively. The left and right belt guides 14L and 14R face each other, project toward each other, and guide inner surfaces of both end portions of the fixing belt 13. The left and right belt guides 14L and 14R support the inner surface of the fixing belt 13 at both end portions of the fixing belt 13 in a width direction (or the Y axis direction) of the fixing belt 13. During rotation of the fixing belt 13, the left and right belt guides 14L and 14R guide the fixing belt 13, and the left and right side plates 12L and 12R restrict movement of the fixing belt 13 in a longitudinal direction of the fixing belt 13.

The stay 15 is located inside the fixing belt 13 and extends over the entire region of the fixing belt 13 in the width direction (or the Y axis direction) of the fixing belt 13. In the stay 15, a heat preservation plate 16, the first heater 17, and the second heater 18 are stacked in this order. The heat preservation plate 16, first heater 17, and second heater 18 are disposed under the stay 15 and extend parallel to the stay 15.

Figure 5:
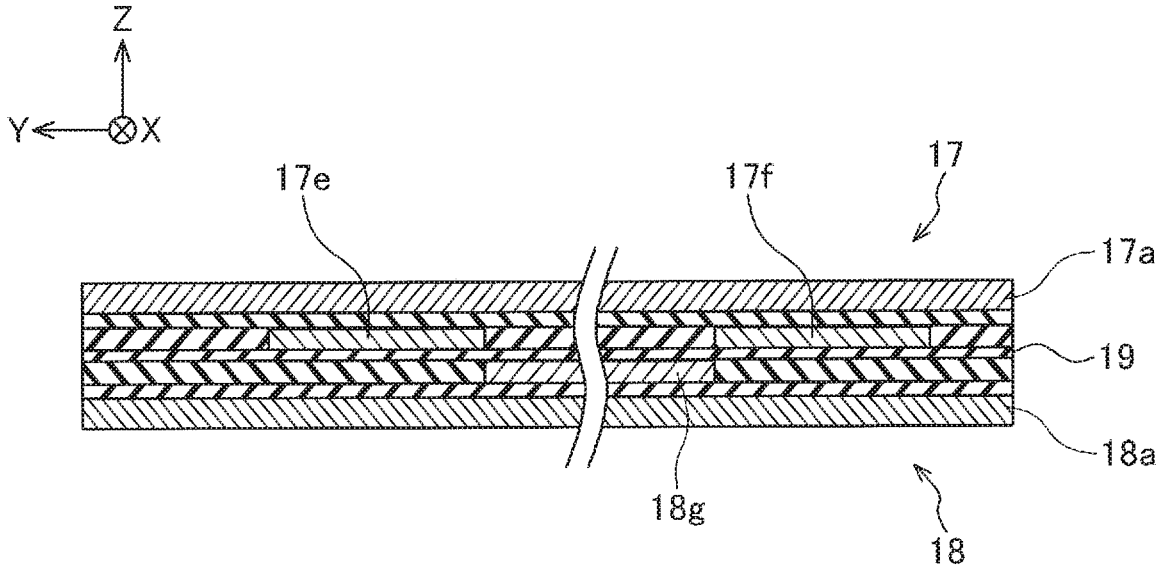
FIG. 5 is a partial enlarged view illustrating the first heater and second heater disposed in a stay together with a heat preservation plate as illustrated in FIG. 2.

The second heater 18 includes a substrate 18*a* formed in a planar shape (see FIG. 5). The second heater 18, which is disposed on the outer side, is disposed so that the substrate 18*a* faces the inner surface of the fixing belt 13 over the entire region of the fixing belt 13 in the width direction of the fixing belt 13, as described later, and left and right end portions of the second heater 18 substantially continue to the left and right belt guides 14L and 14R and guide the inner surface of the fixing belt 13, as illustrated in FIG. 2.

The fixing belt unit 11 configured as described above is held by the body of the fixing device 10 slidably in an up-down direction and urged by an urging member (not illustrated) against the drive roller 21 in the direction of arrow D (here in the negative direction of the Z axis). Thereby, the substrate 18*a* (see FIG. 5) of the second heater 18 presses the drive roller 21 through the fixing belt 13 and forms a nip region 30 in which the pressed portion of the drive roller 21 is deformed into a planar shape along the substrate 18*a*.

In this state, when the drive roller 21 is rotated in the direction of arrow C by a rotational driver 53 (see FIG. 1), the fixing belt 13 rotates in the direction of arrow B in accordance with the rotation of the driver roller 21 while guided by the left and right belt guides 14L and 14R.

Figure 3A:
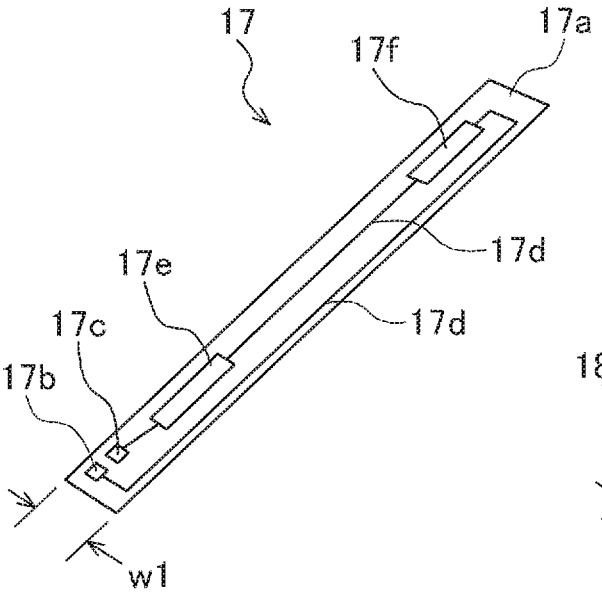
FIG. 3A is an external perspective view of a first heater.
Figure 3B:
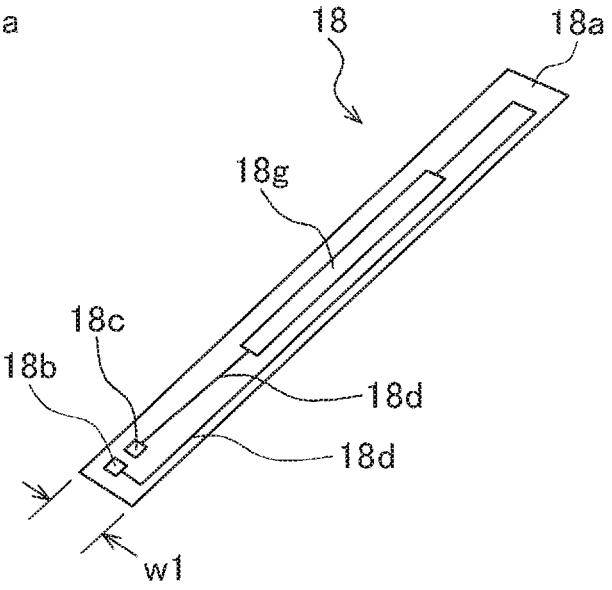
FIG. 3B is an external perspective view of a second heater.
Figure 4A:
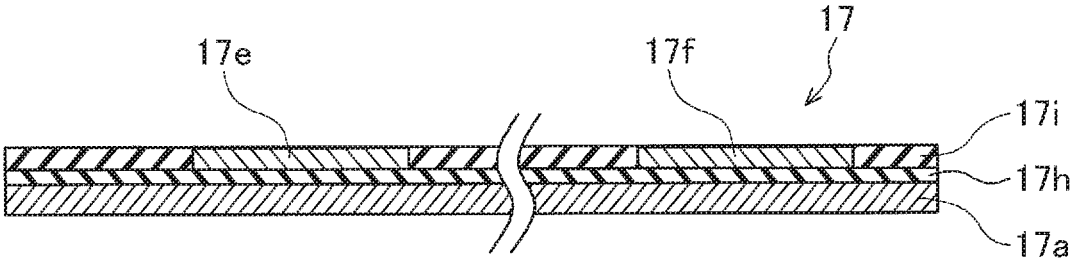
FIG. 4A is a sectional view of the first heater.

FIG. 3A is an external perspective view of the first heater 17, and FIG. 3B is an external perspective view of the second heater 18. FIG. 4A is a sectional view of the first heater 17, and FIG. 4B is a sectional view of the second heater 18.

As illustrated in FIGS. 3A and 4A, the first heater 17 includes a substrate 17*a*, a thin film layer 17*h* as an insulating layer formed on the substrate 17*a*, a pattern formed on the thin film layer 17*h*, and a protective layer 17*i* formed to cover and protect the pattern. The substrate 17*a* is plate-shaped, made of stainless steel (SUS), and disposed so that its longitudinal direction is along the width direction (or the Y axis direction) of the fixing belt 13. The thin film layer 17*h* is made of glass. The pattern includes resistance heating elements 17*e* and 17*f* as heating members, wiring 17*d*, and terminals 17*c* and 17*b*. The protective layer 17*i* is made of glass. As illustrated in FIGS. 3A and 4A, the resistance heating elements 17*e* and 17*f* are separately disposed at two positions near both ends of the substrate 17*a*.

Figure 4B:
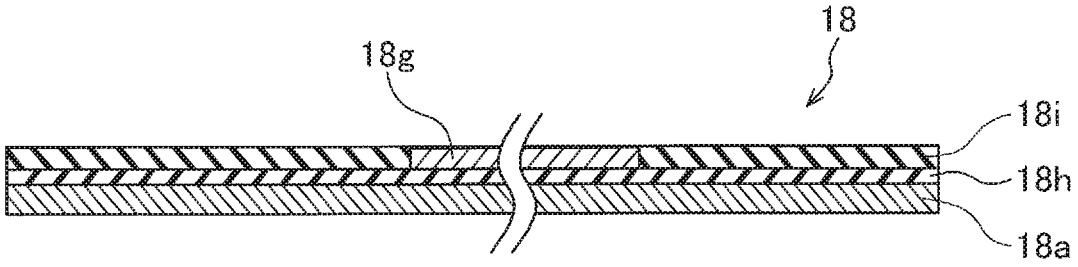
FIG. 4B is a sectional view of the second heater.

As illustrated in FIGS. 3B and 4B, the second heater 18 includes the substrate 18*a*, a thin film layer 18*h* as an insulating layer formed on the substrate 18*a*, a pattern formed on the thin film layer 18*h*, and a protective layer 18*i* formed to cover and protect the pattern. The substrate 18*a* is plate-shaped, made of stainless steel (SUS), and disposed so that its longitudinal direction is along the width direction (or the Y axis direction) of the fixing belt 13. The thin film layer 18*h* is made of glass. The pattern includes a resistance heating element 18*g* as a heating member, wiring 18*d*, and terminals 18*c* and 18*b*. The protective layer 18*i* is made of glass. As illustrated in FIGS. 3B and 4B, the resistance heating element 18*g* is disposed at one position, a central portion of the substrate 18*a*.

FIG. 5 is a partial enlarged view illustrating the first heater 17 and second heater 18 disposed in the stay 15 together with the heat preservation plate 16 as illustrated in FIG. 2.

As illustrated in FIG. 5, when the first heater 17 and second heater 18 are mounted in the stay 15, the resistance heating elements 17*e* and 17*f* of the first heater 17 and the resistance heating element 18*g* of the second heater 18 face each other, and the first heater 17 and second heater 18 are joined together with a layer of heat transfer grease 19 therebetween. The first heater 17 and second heater 18 may be stacked without being fixed to each other. The resistance heating elements 17*e* and 17*f* and resistance heating element 18*g* are alternately arranged in a staggered manner. In the longitudinal direction (or the Y axis direction), the resistance heating element 18*g* is located between the resistance heating elements 17*e* and 17*f* spaced from each other, and a region in which the resistance heating elements 17*e* and 17*f* and resistance heating element 18*g* are disposed includes a region in which the recording sheet 101 passes through the nip region 30.

As illustrated in FIG. 2, the first heater 17 is disposed on the heat preservation plate 16 side and the second heater 18 is disposed on the drive roller 21 side. Thus, an outer surface of the substrate 18*a* of the second heater 18 abuts the inner surface of the fixing belt 13 over the entire region in the width direction of the fixing belt 13 and presses the drive roller 21 through the fixing belt 13 to form the nip region 30. Thus, the fixing belt 13 rotates in the direction of arrow B while the inner surface of the fixing belt 13 is close contact with and slides on the outer surface of the substrate 18*a* of the second heater 18.

In the first heater 17, passing a current between the terminals 17*b* and 17*c* causes the resistance heating elements 17*e* and 17*f* to generate heat. In the second heater 18, passing a current between the terminals 18*b* and 18*c* causes the resistance heating element 18*g* to generate heat. A fixing device temperature controller 54 (see FIG. 1) supplies currents to the first heater 17 and second heater 18, and controls the temperature of the first heater 17 and second heater 18. Thereby, the first heater 17 and second heater 18 heat the sliding portion of the fixing belt 13 rotating in the direction of arrow B, from the inside of the fixing belt 13.

In the above configuration, when a recording sheet 101 with a color image constituted by the toners of the respective colors transferred thereon is conveyed in the direction of arrow A in FIG. 2 to the nip region 30 between the drive roller 21 rotated in the direction of arrow C by the rotational driver 53 (see FIG. 1) and the fixing belt 13 rotating in the direction of arrow B in accordance with the rotation of the drive roller 21, the color image constituted by the toners is heated and pressed when passing through the nip region 30, and thereby fixed onto the recording sheet 101.

Figure 6:
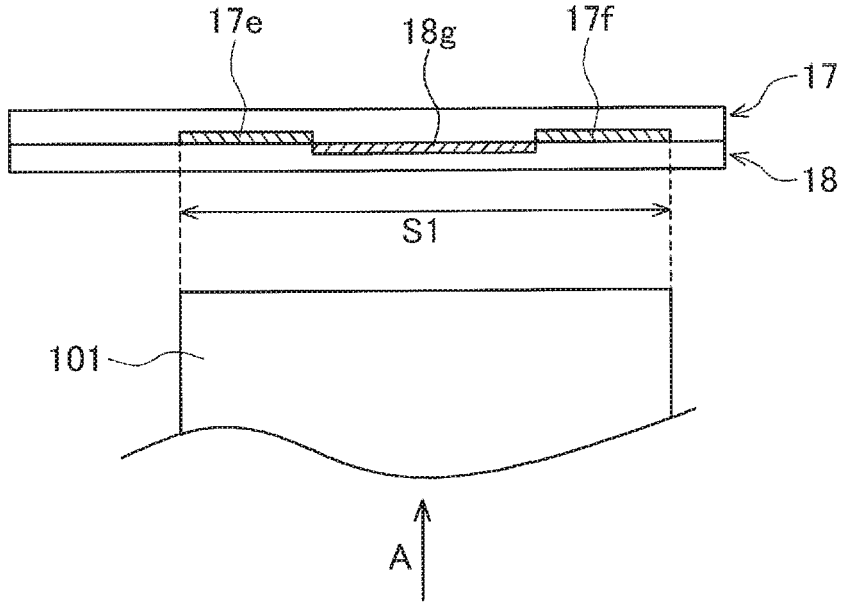
FIG. 6 is a view for explaining a manner of heat generation in a case of fixing to a wide recording sheet.
Figure 7:
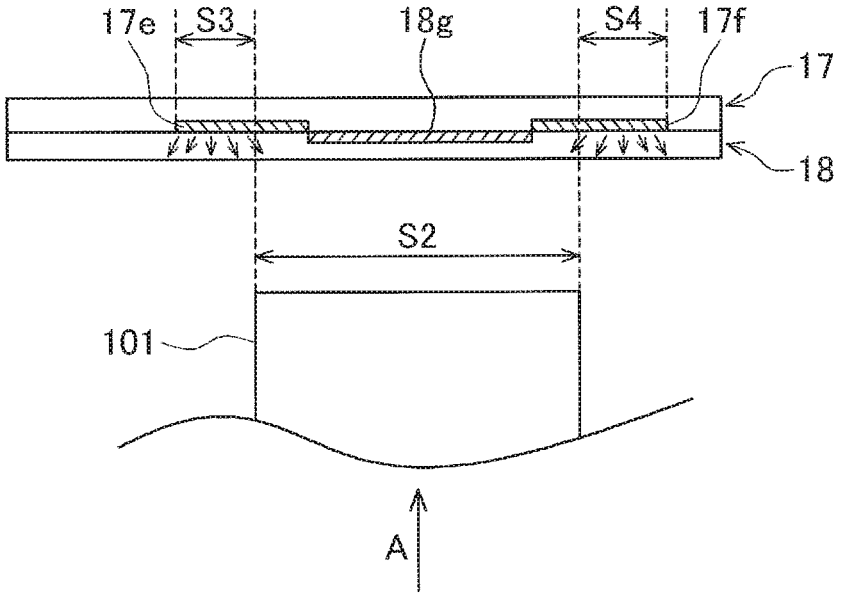
FIG. 7 is a view for explaining a manner of heat generation in a case of fixing to a narrow recording sheet.

Next, the manner of heat generation by the first heater 17 and second heater 18 will be described. FIG. 6 is a view for explaining the manner of the heat generation in a case of fixing to a wide recording sheet 101. FIG. 7 is a view for explaining the manner of the heat generation in a case of fixing to a narrow recording sheet 101.

As illustrated in FIG. 6, in the longitudinal direction of the first heater 17 and second heater 18, the region in which the wide recording sheet 101 passes through the nip region 30 is substantially the same as the region S1 in which the resistance heating elements of the first heater 17 and second heater 18 integrated with each other are disposed. When fixing is performed on the wide recording sheet 101, control is performed so that equal currents flow through the resistance heating elements 17*e*, 17*f*, and 18*g*, and the temperature distribution on the fixing belt 13 in the longitudinal direction is uniform. Here, it is assumed that when equal currents flow through the resistance heating elements 17*e*, 17*f*, and 18*g*, the amounts of heat generation per unit length in the longitudinal direction of the resistance heating elements 17*e*, 17*f*, and 18*g* are equal.

As illustrated in FIG. 7, in the longitudinal direction of the first heater 17 and second heater 18, the region S2 in which the narrow recording sheet 101 passes through the nip region 30 is narrower than the region S1 in which the resistance heating elements of the first heater 17 and second heater 18 integrated with each other are disposed. In fixing, the narrow recording sheet 101 is passed through the nip region 30 with the center of the recording sheet 101 coinciding with the center of the region S1. This forms, in the region S1, non-sheet-passing regions S3 and S4 through which the recording sheet 101 does not pass. When fixing is performed on the narrow recording sheet 101, the fixing device temperature controller 54 controls the current supply so that the amount of current flowing through the resistance heating elements 17*e* and 17*f*, which are located at both end portions, is less than the amount of current flowing through the resistance heating element 18*g*, which is located at the central portion, and the amount of heat generation per unit length of the resistance heating elements 17*e* and 17*f* is less than that of the resistance heating element 18*g*, and thereby prevents the non-sheet-passing regions S3 and S4 from excessively increasing in temperature.

The second heater 18 having the resistance heating element 18*g* at the central portion in the longitudinal direction is located close to the passing recording sheet 101. Thus, heat generated in the non-sheet-passing regions S3 and S4 by the resistance heating elements 17*e* and 17*f* located at both end portions transfers to the second heater 18 and diffuses in the longitudinal direction in the second heater 18. This can prevent the non-sheet-passing regions S3 and S4 from being excessively heated.

Figure 8:
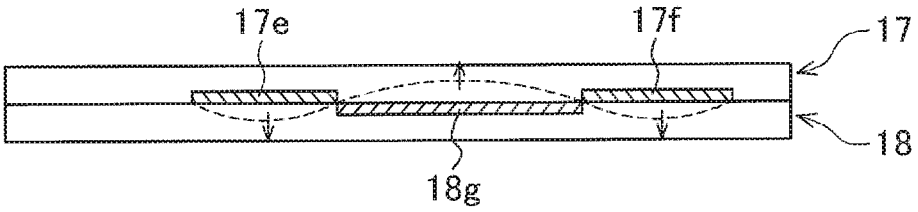
FIG. 8 is a view for explaining deformation due to thermal expansion of resistance heating elements of the first and second heaters integrated with each other.

FIG. 8 is a view for explaining deformation due to thermal expansion of the resistance heating elements 17*e*, 17*f*, and 18*g* of the integrated first and second heaters 17 and 18.

As illustrated in FIG. 8, when the integrated first and second heaters 17 and 18 are mounted in the stay 15, the resistance heating elements 17*e* and 17*f* of the first heater 17 and the resistance heating element 18*g* of the second heater 18 face each other, and the first and second heaters 17 and 18 are joined together with the heat transfer grease 19 therebetween. Thus, when the resistance heating elements 17*e*, 17*f*, and 18*g* deform due to thermal expansion, each of them deforms toward the substrate of the opposite heater, i.e., the resistance heating elements 17*e* and 17*f* deform toward the substrate 18*a* of the second heater 18 and the resistance heating element 18*g* deforms toward the substrate 17*a* of the first heater 17. Thus, heat generated by the resistance heating elements 17*e*, 17*f*, and 18*g* efficiently transfers throughout the integrated first and second heaters 17 and 18.

With the fixing device 10 of the embodiment, it is possible to reduce the width of the nip region 30, and reduce the area of the nip region 30. Thus, it is possible to reduce the thermal capacity of the fixing belt 13 and members inside the fixing belt 13, and reduce the warm-up time of the device.

Figure 12:
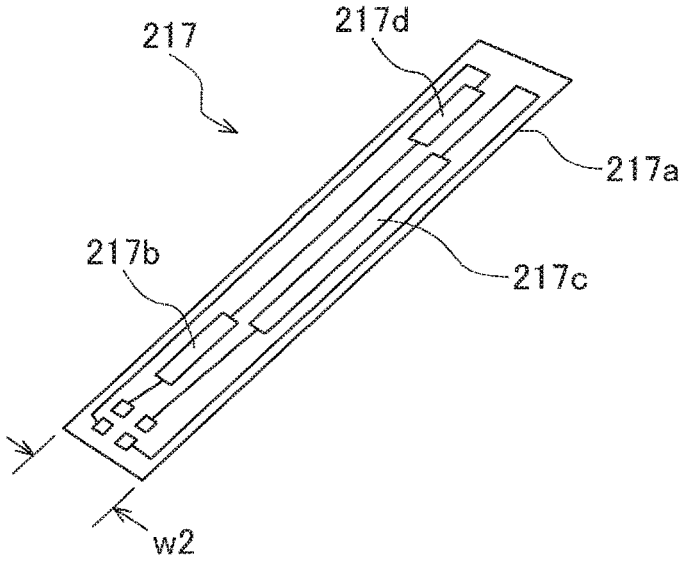
FIG. 12 RELATED ART
FIG. 12 is an external perspective view of a heater of a comparative example.
Figure 13:
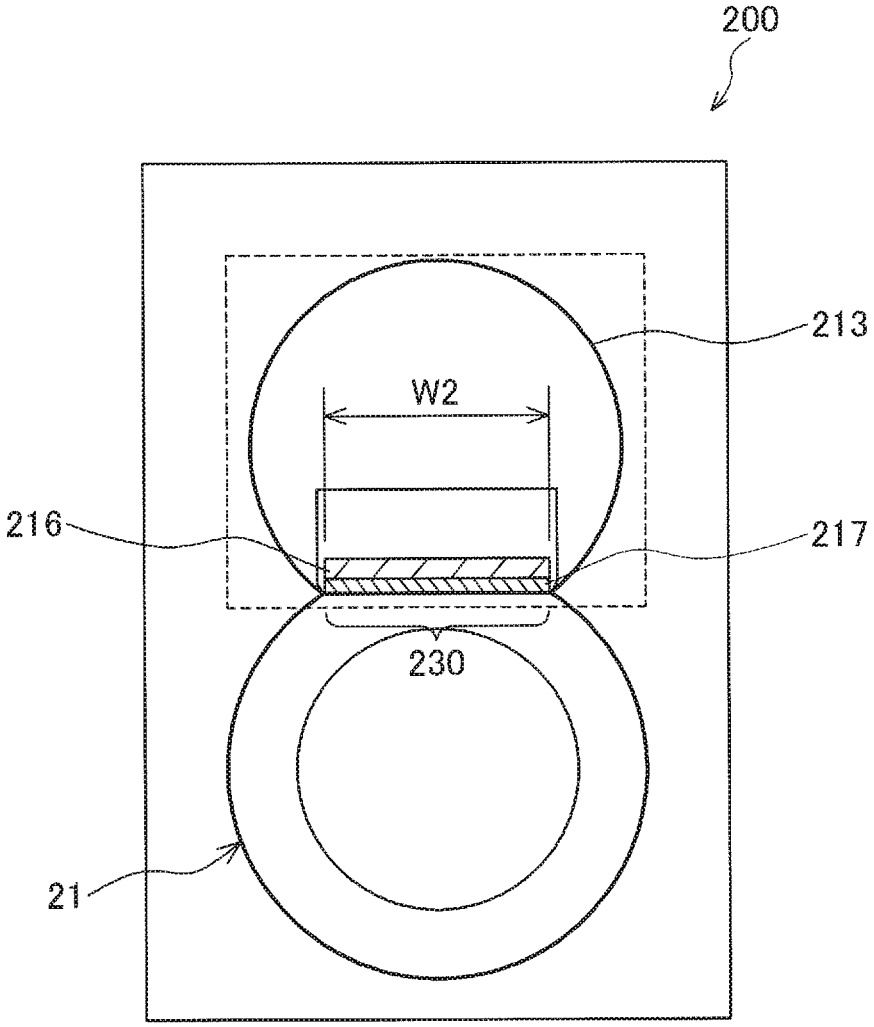
FIG. 13 RELATED ART
FIG. 13 is a view of main components of a fixing device employing the heater of the comparative example.

Next, compared to a comparative example, features of the fixing device 10 of the embodiment will be described. FIG. 12 is an external perspective view of a heater 217 of the comparative example. FIG. 13 is a view of a fixing device 200 employing the heater 217 of the comparative example.

As illustrated in FIG. 12, the heater 217 of the comparative example includes resistance heating elements 217*b* and 217*d* for heating both end portions of a fixing belt 213 (see FIG. 13) in the width direction and wiring therefor, and a resistance heating element 217*c* for heating a central portion of the fixing belt 213 in the width direction and wiring therefor, which are patterned on a single substrate 217*a*. Thus, a width w2 (see FIGS. 12 and 13) of the heater 217 is greater than a width w1 (see FIGS. 3A and 3B) of the first heater 17 and second heater 18 of the fixing device 10 of the embodiment. Here, the width w2 is about 1.6 times the width w1.

As illustrated in FIG. 13, the fixing device 200 of the comparative example employing the heater 217 has a nip region 230, which is about 1.6 times wider than the nip region 30 (see FIG. 2) of the fixing device 10 of the embodiment. Thus, when the circumferential length of the fixing belt 213 is the same as that of the fixing device 10 of the embodiment, the fixing belt 213 rotates while considerably distorted relative to the circular cylindrical shape, as illustrated in FIG. 13.

The fixing device 10 of the embodiment has the following features (1) to (3).

(1) The first heater 17 that heats both end portions in the width direction of the fixing belt 13 and the second heater 18 that heats the central portion in the width direction of the fixing belt 13 are separately formed, for example as illustrated in FIGS. 3A and 3B. Thus, each heater can be constituted by resistance heating element(s) for a single heating pattern and wiring therefor. This allows the width w1 (see FIGS. 3A and 3B) of each heater to be small (e.g., 10 mm or less). This can reduce the area of the nip region 30 (see FIG. 2), the thermal capacity of members inside the fixing belt 13, and the thermal capacity of the fixing belt 13 for a reason described below. This can reduce the warm-up time from when the fixing device 10 is activated to when the temperature of the heaters reaches a temperature at which the fixing device 10 can operate, and also contribute to downsizing of the device.

On the other hand, as illustrated in FIG. 12, the width w2 of the heater 217 of the comparative example is greater than the width w1, and is 16 mm or more. Thus, the area of the nip region 230 (see FIG. 13) is large, and the thermal capacity of members inside the fixing belt 213 is large.

Also, in the fixing device 200 of the comparative example, since the area of the nip region 230 (see FIG. 13) is large, when the circumferential length of the fixing belt 213 is the same as that of the fixing belt 13 (see FIG. 2), the fixing belt 213 is considerably deformed and distorted from the circular cylindrical shape, as illustrated in FIG. 13. The fixing belt 213 may be permanently deformed, thereby degrading print quality. To make the distortion of the fixing belt 213 comparable with that of the fixing belt 13 to prevent the above problem, it is required that the fixing belt 213 have an inner diameter 1.6 times larger than that of the fixing belt 13. This enlarges the device, and increases the thermal capacity of the fixing belt 213.

(2) The first heater 17 and second heater 18 are stacked so that the second heater 18 for heating the central portion of the fixing belt 13 is located closer to the fixing belt 13 than the first heater 17. This provides the effect that heat generated by the first heater 17 for heating the end portions of the fixing belt 13 is diffused, as described with FIG. 7.

(3) The resistance heating elements 17*e* and 17*f* of the first heater 17 and the resistance heating element 18*g* of the second heater 18 are disposed to face each other. Thus, as described with FIG. 8, when the resistance heating elements 17*e*, 17*f*, and 18*g* deform due to thermal expansion, each of them deforms toward the substrate of the opposite heater. This stabilizes heat transfer between the first heater 17 and the second heater 18.

The fixing device 10 of the embodiment may be modified as follows.

First Modification

Figure 9:
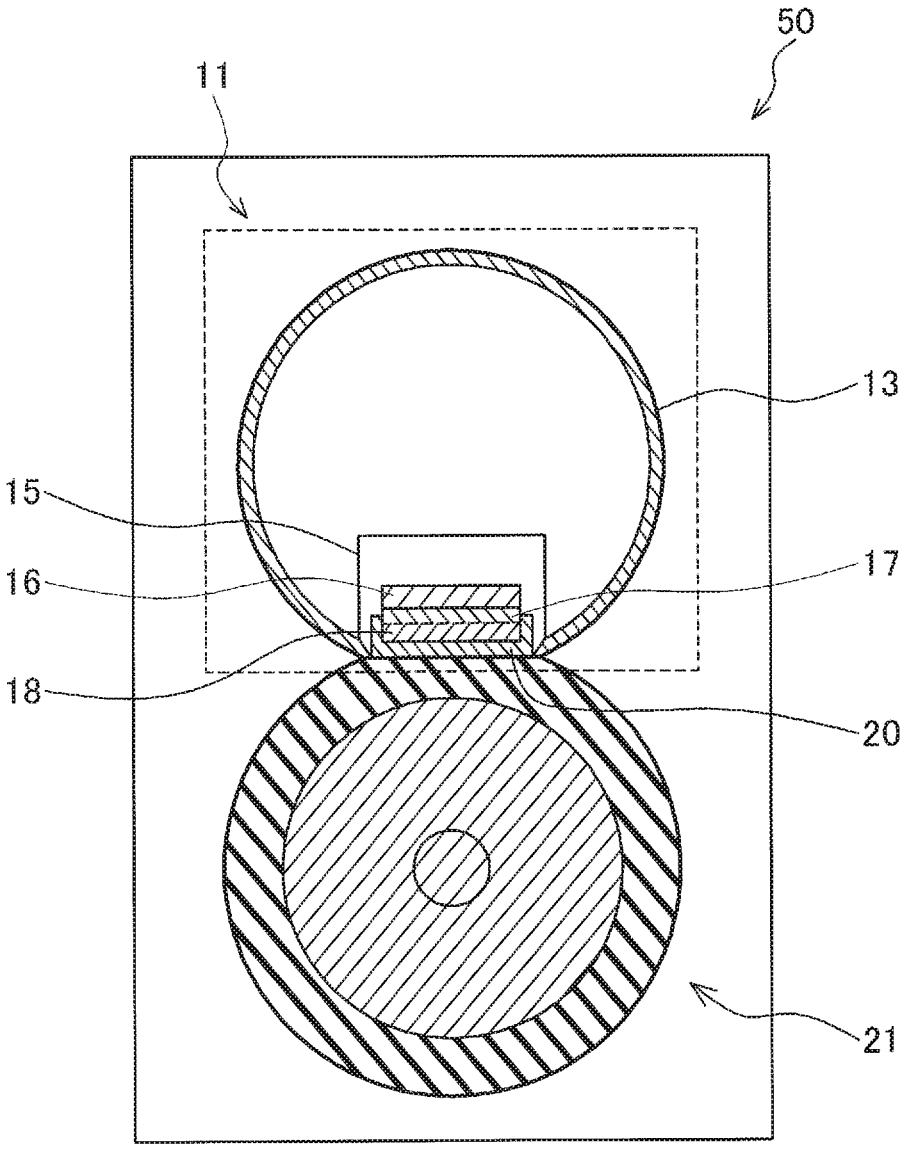
FIG. 9 is a view of main components of a fixing device of a first modification.

FIG. 9 is a view of main components of a fixing device 50 of a first modification.

The fixing device 50 of the first modification differs from the fixing device 10 of the embodiment illustrated in FIG. 2 in that a heat diffusion member 20 is disposed between the integrated first and second heaters 17 and 18 and the fixing belt 13, more specifically between the substrate 18*a* (see FIG. 5) of the second heater 18 and the inner surface of the fixing belt 13. The heat diffusion member 20 is or includes, for example, a metal plate made of stainless steel, aluminum alloy, iron, or the like.

The heat diffusion member 20 can further uniform the heat distribution in the width direction (or Y axis direction) when the fixing belt 13 is heated. However, in terms of thermal efficiency, the heat diffusion member 20 may be omitted.

Second Modification

Figure 10:
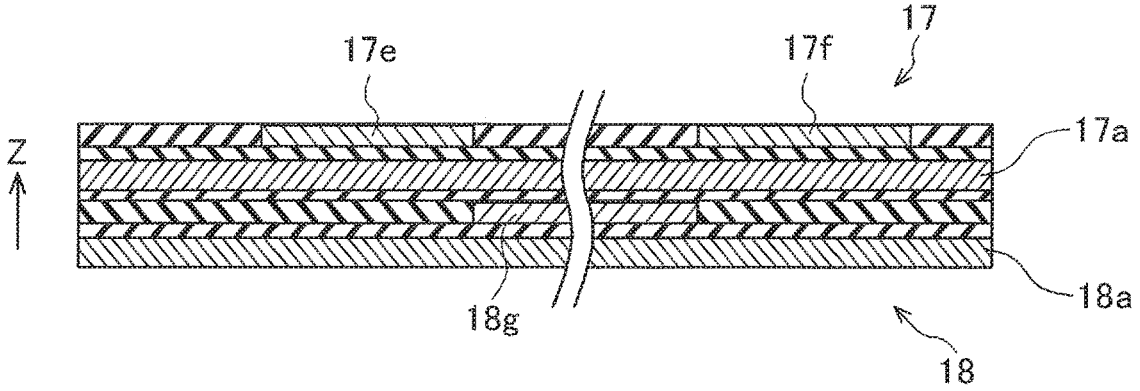
FIG. 10 is a view of a first heater and a second heater of a fixing device of a second modification.

FIG. 10 is a view of the first heater 17 and second heater 18 of a fixing device of a second modification. FIG. 10 is a partial enlarged view illustrating the first heater 17 and second heater 18 disposed in the stay 15 together with the heat preservation plate 16 as illustrated in FIG. 2.

The heater portion of the fixing device of the second modification differs in configuration from the heater portion of the fixing device 10 of the embodiment illustrated in FIG. 5 in that the orientation of the first heater 17 in the up-down direction (or Z axis direction) in the second modification is opposite to that in the embodiment. Specifically, the resistance heating elements 17*e* and 17*f* of the first heater 17 and the resistance heating element 18*g* of the second heater 18 do not face each other, and the orientation of the resistance heating elements 17*e* and 17*f* relative to the substrate 17*a* is the same as the orientation of the resistance heating element 18*g* relative to the substrate 18*a*. The resistance heating elements 17*e* and 17*f* are located on the positive side of the Z axis direction relative to the substrate 17*a*.

Third Modification

Figure 11:
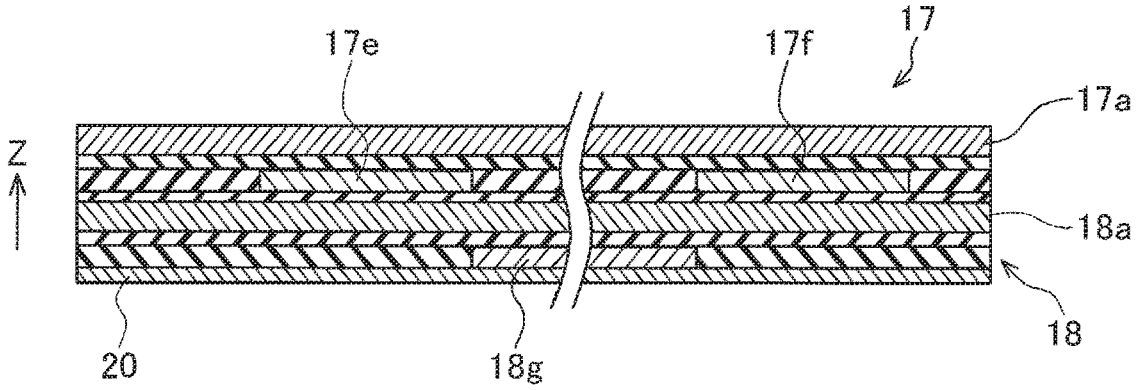
FIG. 11 is a view of a first heater and a second heater of a fixing device of a third modification.

FIG. 11 is a view of the first heater 17 and second heater 18 of a fixing device of a third modification. FIG. 11 is a partial enlarged view illustrating the first heater 17 and second heater 18 disposed in the stay 15 together with the heat preservation plate 16 as illustrated in FIG. 2.

The heater portion of the fixing device of the third modification differs in configuration from the heater portion of the fixing device 10 of the embodiment illustrated in FIG. 5 in that the orientation of the first heater 18 in the up-down direction (or Z axis direction) in the third modification is opposite to that in the embodiment. Specifically, the resistance heating element 18*g* of the second heater 18 and the resistance heating elements 17*e* and 17*f* of the first heater 17 do not face each other, and the orientation of the resistance heating element 18*g* relative to the substrate 18*a* is the same as the orientation of the resistance heating elements 17*e* and 17*f* relative to the substrate 17*a*. The resistance heating element 18*g* is located on the negative side of the Z axis direction relative to the substrate 18*a*. Further, here, to prevent the resistance heating element 18*g* from directly contacting the fixing belt 13 (see FIG. 2), a heat diffusion member 20 is disposed between the second heater 18 and the fixing belt 13.

Although the second and third modifications do not have the feature (3) of the fixing device 10 of the embodiment, they are usable when there is no need to consider thermal deformation (or warpage) of the substrates.

The present invention is not limited to the embodiment described above; it can be practiced in various other aspects without departing from the scope of the invention.

For example, in the fixing device 10 of the embodiment, two heaters, the first heater 17 and second heater 18, are stacked. However, this is merely an example, and three or more heaters may be stacked.

Also, in the fixing device 10, the drive roller 21 is employed as a member that forms the nip region 30. However, this is not mandatory, and other members, such as a belt, may be used as the opposite member instead of the driver roller 21.

In the above description of the embodiment, directional terms, such as "up", "down", "left", "right", "front", or "rear", are used. However, these are used for convenience, and not intended to absolutely limit positional relationships in a state where the fixing device 10 is placed.

In the above embodiment, the present invention has been described by taking, as an example, a fixing device of a color electrophotographic printer. However, the present invention is not limited to this, and it is also applicable to fixing devices of image forming apparatuses, such as copiers, facsimile machines, or multi-function peripherals (MFPs), that form images on recording media by electrophotography. Also, although the above embodiment has described a color printer, the present invention is applicable to monochrome printers.

What is claimed is:

1. A fixing device comprising:

a belt unit; and a pressure member that is pressed against the belt unit to form a nip region between the pressure member and the belt unit, the belt unit and the pressure member being configured to, when a recording medium with a developer image transferred thereon passes through the nip region in a conveying direction, fix the developer image to the recording medium, wherein the belt unit includes:

an endless belt extending in a width direction perpendicular to the conveying direction;

a heater group comprising a plurality of stacked heaters; and a holder that holds the heater group inside the belt, wherein each one of the plurality of heaters of the heater group includes a substrate and at least one heating member disposed on the substrate, and wherein the plurality of heaters of the heater group are arranged so that the heating members of the plurality of heaters are located at different regions in the width direction of the belt.

2. The fixing device of claim 1, wherein the plurality of heaters of the heater group have different heating-patterns.

3. The fixing device of claim 1, wherein the plurality of heaters of the heater group comprise a heater disposed closest to the belt, and the at least one heating member of the heater disposed closest to the belt comprises a heating member disposed at a central portion of the heater in the width direction of the belt.

4. The fixing device of claim 1, wherein the plurality of heaters of the heater group comprise a first heater and a second heater disposed closer to the belt than the first heater, the at least one heating member of the first heater comprises a pair of heating members located at end portions of the first heater in the width direction of the belt, and the at least one heating member of the second heater comprises a heating member located between the pair of heating members in the width direction of the belt.

5. The fixing device of claim 4, wherein the first heater and the second heater are stacked so that the at least one heating member of the first heater and the at least one heating member of the second heater face each other and are sandwiched between the substrate of the first heater and the substrate of the second heater in a direction perpendicular to both the conveying direction and the width direction.

6. The fixing device of claim 1, further comprising a heat diffusion plate disposed between the heater group and the belt.

7. The fixing device of claim 1, wherein the plurality of heaters of the heater group are stacked without being fixed to each other.

8. An image forming apparatus comprising the fixing device of claim 1.

9. The fixing device of claim 1, wherein the plurality of heaters of the heater group are stacked in a direction perpendicular to both the conveying direction and the width direction.

10. The fixing device of claim 1, wherein the plurality of heaters of the heater group are arranged so that the heating members of the plurality of heaters overlap one another in the conveying direction and do not overlap one another in the width direction.

* * * * *